US006095754A

United States Patent [19]

Ono

[11] Patent Number: 6,095,754

[45] Date of Patent: Aug. 1, 2000

[54] TURBO-MOLECULAR PUMP WITH METAL MATRIX COMPOSITE ROTOR AND STATOR

[75] Inventor: Masanori Ono, Chiba-Prefecture, Japan

[73] Assignee: Applied Materials, Inc., Santa Clara, Calif.

[21] Appl. No.: 09/073,899

[22] Filed: May 6, 1998

[51] Int. Cl.[7] ..... B63H 1/26

[52] U.S. Cl. ..... 416/224

[58] Field of Search ..... 118/715; 156/345; 417/423.4; 416/224; 415/200

[56] References Cited

U.S. PATENT DOCUMENTS

| | | | |
|---|---|---|---|
| 4,681,519 | 7/1987 | Sakamaki et al. | 418/152 |
| 4,913,619 | 4/1990 | Haentjens et al. | 415/172.1 |
| 5,106,273 | 4/1992 | Lemarquand et al. . | |
| 5,350,275 | 9/1994 | Ishimaru . | |
| 5,439,750 | 8/1995 | Ravenhall et al. . | |
| 5,490,764 | 2/1996 | Shilling . | |
| 5,516,380 | 5/1996 | Darolia et al. . | |
| 5,524,699 | 6/1996 | Cook | 164/97 |
| 5,529,748 | 6/1996 | Moreton et al. . | |
| 5,573,607 | 11/1996 | Weaver . | |
| 5,728,638 | 3/1998 | Strange et al. | 501/127 |
| 5,782,609 | 7/1998 | Ikemoto et al. | 417/44.1 |

OTHER PUBLICATIONS

"Vacuum Pump Designs Adjust to Harsher Conditions," Semiconductor International, Oct. 1997 pp. 87–90.

*Primary Examiner*—Richard Bueker
*Assistant Examiner*—Erin Kieler
*Attorney, Agent, or Firm*—Thomason, Moser and Patterson

[57] ABSTRACT

The invention provides a vacuum processing system comprising a vacuum processing chamber and a turbo-molecular pump having a rotor and/or stator comprised of metal matrix composites. Another aspect of the invention provides a turbo-molecular pump having a rotor and/or a stator comprised of metal matrix composites. Because metal matrix composites are able to withstand higher operating temperatures than the aluminum alloys currently used in rotors and stators, the rotor vanes and the stator vanes that are made of metal matrix composites can provide a higher exhaust capacity with faster rotor rotations.

15 Claims, 2 Drawing Sheets

TURBO-MOLECULAR PUMP WITH METAL MATRIX COMPOSITE ROTOR AND STATOR

BACKGROUND OF THE INVENTION

1. Field of the Invention

The present invention generally relates to semiconductor processing. Specifically, the present invention relates to a turbo-molecular vacuum pump for evacuating a vacuum processing chamber used in semiconductor processing.

2. Background of the Related Art

Substrates are typically processed through various etch, chemical vapor deposition (CVD), physical vapor deposition (PVD), and cleaning steps to construct integrated circuits or other structures thereon. These steps are usually performed in an environmentally isolated and vacuum sealed substrate processing chamber. The substrate processing chamber generally comprises an enclosure having a side wall, a bottom and a lid. A substrate support member is disposed within the chamber to secure a substrate in place during processing by electrical or mechanical means such as an electrostatic chuck or a vacuum chuck. A slit valve is disposed on a chamber side wall to allow the transfer of the substrate into and out of the substrate processing chamber. Various process gases enter into the substrate processing chamber through a gas inlet, such as a shower-head type gas inlet, disposed through the lid of the processing chamber. To exhaust the gases from the substrate processing chamber, a vacuum pump, such as a turbo-molecular pump, is attached to a gas outlet of the substrate processing chamber.

Substrate processes such as plasma-based etch and CVD, are critically dependent on the reaction of gas molecules and reactive ions at the substrate surface because the concentration, the arrival rate and the directionality of the reactive gases and ions determine the process parameters such as the etch rate, the etch profile, the deposition rate, the deposition profile, the step coverage and the process uniformity. These parameters are usually controlled by the flow rates of the process gases and the chamber pressure, as well as the energy of the plasma and the distance of the plasma from the substrate. Particularly, the plasma-based etch and CVD processes require high process gas flow rates and relatively shallow vacuum levels. As the flow rate of the reactants across the substrate processing surface is increased (i.e., the throughput of the vacuum pump increases to exhaust a higher volume), the time required for completion of the process is reduced. Thus, to increase throughput of the processing chamber, the vacuum pumping system used for plasma-based etch and CVD, particularly for high density plasma (HDP) processes, must have a high throughput or exhaust capacity. Furthermore, as the chamber sizes increase to accommodate larger substrates (i.e., 300 mm substrates), the vacuum pumps, such as turbo-molecular pumps, used for these larger chambers must provide correspondingly larger exhaust capacities.

To increase the throughput or exhaust capacity of the vacuum pump and to decrease the time it takes to exhaust gases from a processing chamber, the pump size (i.e., physical capacity and size) of the turbo-molecular pump is typically enlarged. However, implementing larger pumps on existing systems often requires expensive and time-consuming retrofits such as pipe fittings that are required to provide the transition from the gas outlet of the chamber to the gas inlet of the larger turbo-molecular pump. Furthermore, larger pumps are typically more expensive and require larger "footprints" of the processing system. Larger footprints occupy more valuable clean-room space and may also require reconfiguration of the processing equipment.

Another way to decrease exhaust time and increase throughput of the pump is to increase the rotational speed of the rotor of the turbo-molecular pump. However, because of the high throughput of the process gases through the vacuum pump, unused reactants as well as reaction byproducts are removed from the processing chamber at a high rate and can either adhere to or react with the surfaces of the components inside the vacuum pump, causing the components to heat up significantly and resulting in breakdown of the component as well as the pump. For example, in HDP applications, the pump internal components, such as a rotor, can heat above 120° C., and the stress caused by the high temperature causes physical break down of the component and the pump.

Therefore, there is a need for a turbo-molecular vacuum pump that provides a higher exhaust capacity than existing turbo-molecular pumps of approximately same physical sizes. In addition, there is a need for such a turbo-molecular pump that can be retrofitted onto existing processing chambers to improve throughput of existing systems.

SUMMARY OF THE INVENTION

The invention provides a turbo-molecular vacuum pump that provides a higher exhaust capacity than existing turbo-molecular pumps of approximately same physical sizes. The invention also provides a turbo-molecular pump that can be retrofitted onto existing processing chambers to improve throughput of existing systems.

Another aspect of the invention provides a vacuum processing system comprising a vacuum processing chamber and a turbo-molecular pump disposed on the vacuum processing chamber. The turbo-molecular pump comprises a casing having an inlet port and an outlet port, a stator disposed on an inner wall of the casing, a rotor disposed in the stator, and a motor extending coaxially with the rotor, wherein both the rotor/rotor vanes and the stator/stator vanes are made from a metal matrix composite. Alternatively, only the rotor and rotor vanes are made of a metal matrix composite.

The metal matrix composite comprises a metal base and a strengthening additive. Preferably, the metal base comprises aluminum, and the strengthening additive comprises a material chosen from the group consisting of: silicon carbide whiskers, fibers of boron metal, fibers of carbon, fibers of aluminum silicate, fibers of aluminum oxide, aluminum oxide particulates, boron carbide particles, silicon hexaboride particles, or silicon carbide particles. Preferably, both the rotor and the stator of the turbo-molecular pump are made from a metal matrix composite.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

The invention provides a turbo-molecular pump having a rotor and/or a stator comprised of metal matrix composites. Because metal matrix composites are able to withstand higher operating temperatures than the aluminum alloys currently used in rotors and stators, the rotor vanes and the stator vanes that are made of metal matrix composites can provide a higher exhaust capacity with faster rotor rotations.

Figure 1:
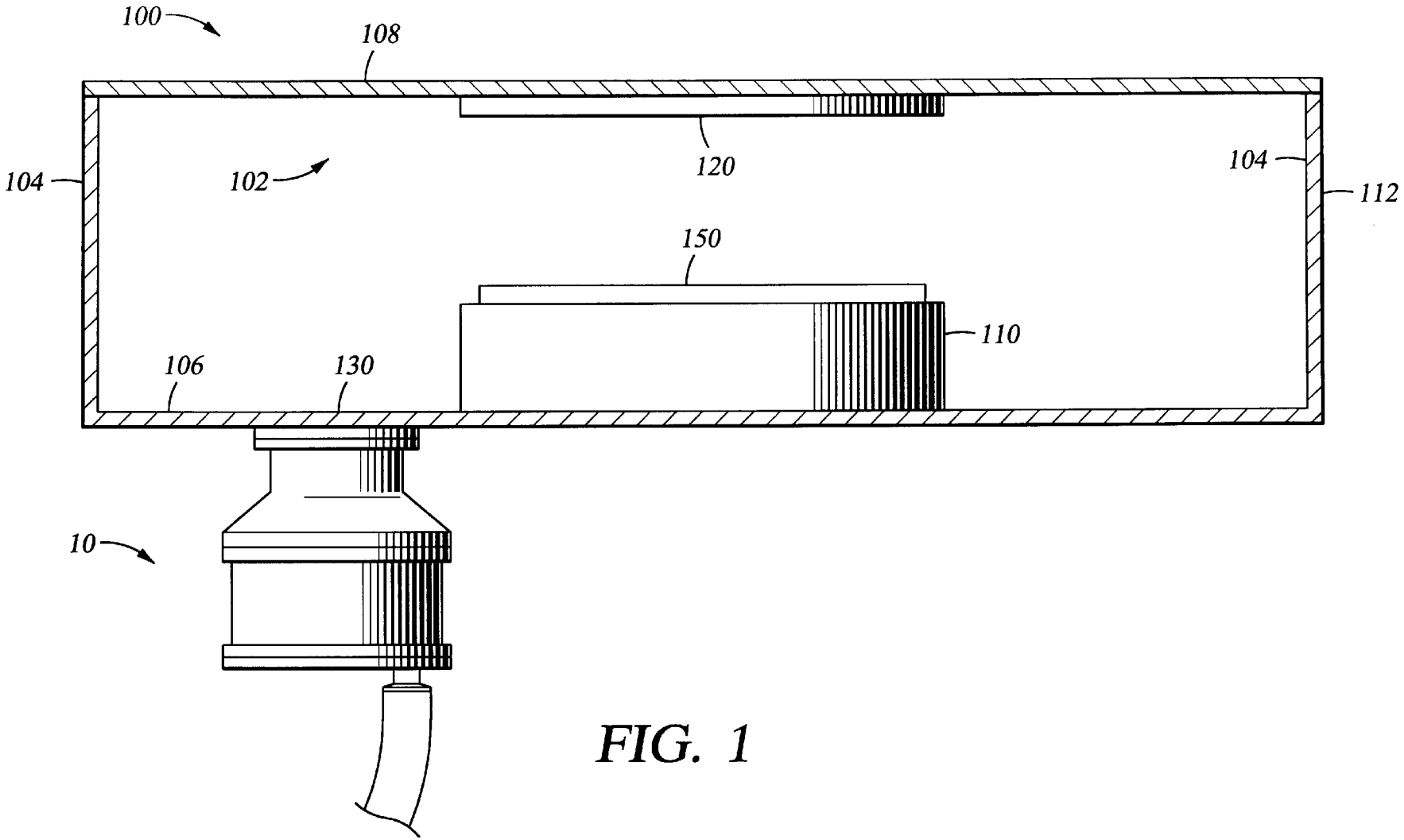
FIG. 1 is a simplified schematic cross sectional view of a vacuum substrate processing chamber 100 having a turbo-molecular pump 10 attached thereto.

FIG. 1 is a simplified schematic cross sectional view of a vacuum substrate processing chamber 100 having a turbo-molecular pump 10 attached thereto. The chamber 100 provides an isolated environment where a substrate 150 is processed through etching, deposition, cleaning, cooling and/or other pre-processing and post-processing steps. The substrate processing chamber 100 generally comprises an enclosure having a side wall 104, a bottom 106 and a lid 108. A substrate support member 110 disposed on the bottom 106 secures the substrate 150 in place during processing. The substrate support member 110 typically comprises a vacuum chuck or an electrostatic chuck. A slit valve 112 is disposed on the chamber side wall 104 to allow the transfer of the substrate 150 into and out of the substrate processing chamber 100. Various process gases enter into the substrate processing chamber 100 through a gas inlet 120, such as a shower-head type gas inlet, disposed through the lid 108 of the processing chamber. To exhaust the gases from the substrate processing chamber, a turbo-molecular pump 10 according to the present invention is attached to a gas outlet 130 of the substrate processing chamber.

Figure 2:
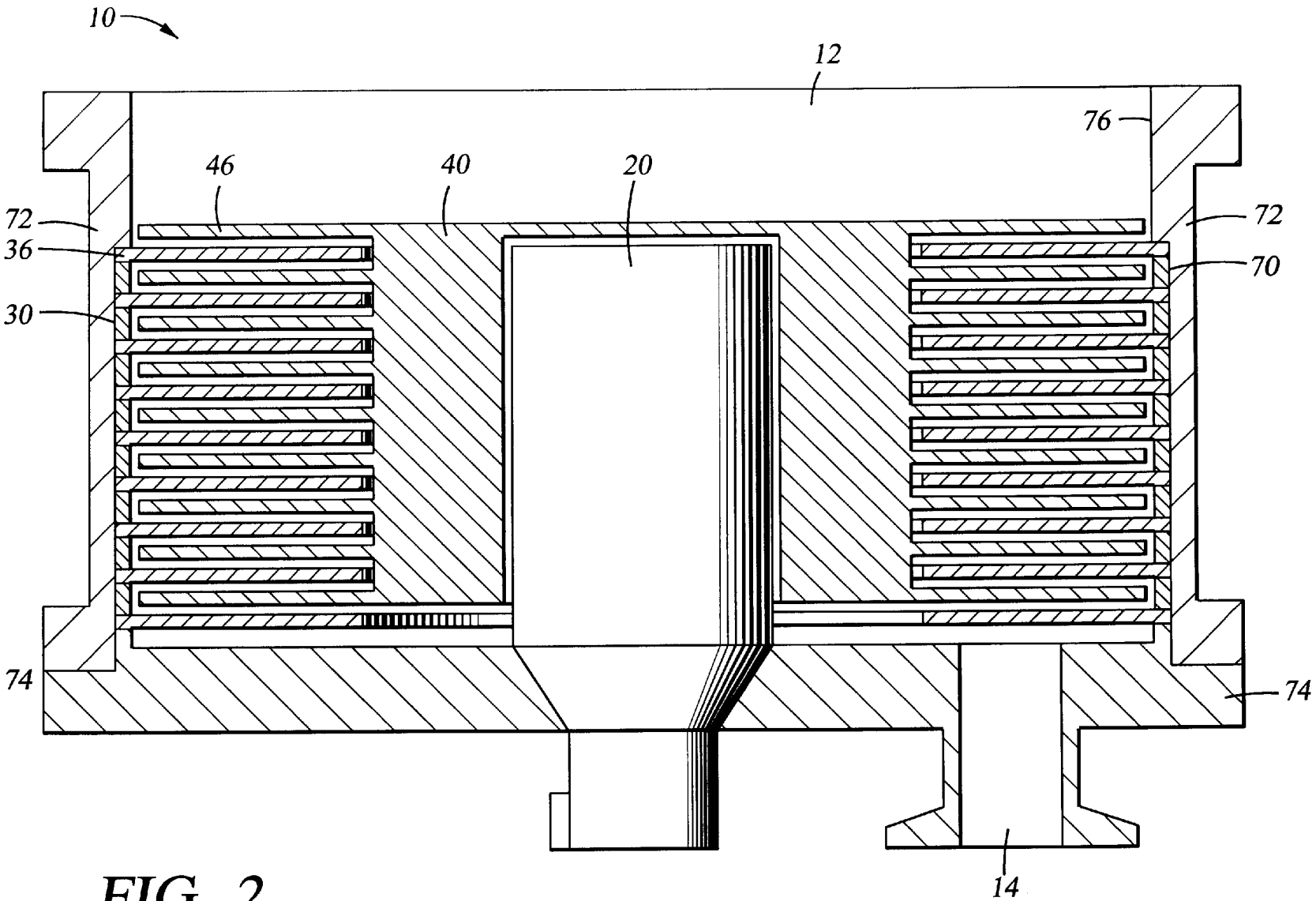
FIG. 2 is a cross sectional view of a turbo-molecular pump 10 of the invention.

FIG. 2 is a cross sectional view of a turbo-molecular pump 10 of the invention. The turbo-molecular pump 10 generally comprises a cylindrical casing 72, a base 74 closing the bottom of the casing 72, a rotor 40 disposed coaxially in the casing 72, a motor 20 coaxially disposed within the rotor 40, and a stator 30 extending radially inwardly from the casing 72. The casing 72 provides the support structure of the turbo-molecular pump 10 and includes an inlet port 12 disposed through the top of the casing 72. An outlet port 14 is disposed through the base 74 and attached to various hoses and tanks for recovery or disposal of the gases. The motor 20 is an electrical/mechanical motor that rotates the rotor 40 about a central axis.

The rotor 40 includes a plurality of rotor vanes 46 extending radially outwardly from a central cylinder that receives a portion of the motor 20. The rotor vanes 46 are arranged in axial intervals or levels along the height of the rotor 40. The stator 30 includes a plurality of the stator vanes 36 extending radially inwardly from the casing 72. The stator vanes 36 are arranged at alternating axial levels with the rotor vanes 46, and a plurality of spacer rings 38 separate different levels of stator vanes 36 to ensure that the rotor vanes 46 can rotate freely between stator vanes 36. Preferably, the rotor 40 is suspended by magnetic bearings in a floating condition with the casing and in the gaps between the stator vanes 36. Alternatively, the rotor is suspended by mechanical bearings. The rotor vanes 46 and the stator vanes 36 are shaped to pump gas from the inlet port 12 to the outlet port 14 and to prevent gas flow back into the vacuum processing chamber 100 when the rotor vanes 46 are rotating between the stator vanes 36. Preferably, both the rotor vanes 46 and the stator vanes 36 comprises a metal matrix composite to provide a higher exhaust capacity and a higher maximum operating temperature for the turbo-molecular pump.

A metal matrix composite as contemplated by the invention generally comprises a composition of a base metal, such as aluminum or magnesium, and an additive, such as a ceramic. The mixing of ceramics with metals typically increases the modulus of elasticity and the coefficient of expansion of the metals. For example, fibrous materials, such as silicon carbide whiskers, provide an enhanced mechanical strength to the base metal. Thus, rotor vanes and stator vanes made of metal matrix composites are capable of enduring higher operating temperatures because of the superior mechanical strength as compared to typical aluminum alloys. Other additives for use in a metal matrix composition include fibers of boron metal, carbon, aluminum silicate, and aluminum oxide, boron carbide, silicon hexaboride and silicon carbide. One particular metal matrix composite that exhibits similar characteristics as aluminum alloy but with an improved mechanical strength is a silicon carbide (SiC) composition having the boundaries among SiC particles filled with aluminum.

In operation, a substrate 150 is transferred into the chamber 100 through the slit valve 112 and placed on the substrate support member 110. The substrate support member 110 holds the substrate 150 during processing. To commence processing, the slit valve 112 is closed to provide a sealed environment in the chamber 100, and the chamber is evacuated by the turbo-molecular pump 10 to a desired vacuum level. A processing gas is then introduced into the chamber 100 through the gas inlet 120 and a plasma is struck in the chamber 100 to enhance the CVD process. As the CVD process continues, the turbo-molecular pump 10 continues to pump out the processing gas and the reactant byproducts so that a proper pressure is maintained in the process chamber 10 during processing. The turbo-molecular pump having rotor vanes and stator vanes made of metal matrix composites according to the invention provides higher exhaust capacities by increasing the rotor speed and the corresponding required higher operating temperature of the pump. The turbo-molecular pump of the invention allows a higher flow rate of the process gases to decrease process time and increase throughput. After processing, the substrate 150 is transferred out of the chamber 100, and another substrate is transferred into the chamber to be processed.

Although the substrate deposition process is described with respect to a CVD chamber, the benefits of the present invention are equally realizable in other vacuum processing chambers and vacuum processing systems that utilize turbo-molecular pumps.

While the foregoing is directed to the preferred embodiment of the present invention, other and further embodiments of the invention may be devised without departing from the basic scope thereof, and the scope thereof is determined by the claims which follow.

I claim:

1. A vacuum processing system, comprising:

(a) a vacuum processing chamber; and (b) a turbo-molecular pump disposed on the vacuum processing chamber, comprising:

(i) a casing having an inlet port and an outlet port;

(ii) a stator having a plurality of stator vanes extending radially inwardly from an inner surface of the casing;

(iii) a rotor having a plurality of rotor vanes disposed in an alternating arrangement with the stator vanes, wherein the rotor vanes consisting of a metal matrix composite; and (iv) a motor disposed coaxially with the rotor.

2. The vacuum processing system of claim 1 wherein the vacuum processing chamber is a chemical vapor deposition chamber.

3. The vacuum processing system of claim 1 wherein the vacuum processing chamber is an etch chamber.

4. The vacuum processing system of claim 1 wherein the stator vanes comprise a metal matrix composite.

5. The vacuum processing system of claim 1 wherein the metal matrix composite comprises a metal base and a strengthening additive.

6. The vacuum processing system of claim 5 wherein the metal base is aluminum.

7. The vacuum processing system of claim 6 wherein the strengthening additive comprises an additive selected from the group consisting of: silicon carbide whiskers, fibers of boron metal, fibers of carbon, fibers of aluminum silicate, fibers of aluminum oxide, aluminum oxide particulates, boron carbide particles, silicon hexaboride particles and silicon carbide particles.

8. An apparatus for evacuating a gas from a processing chamber, comprising:

(a) a turbo-molecular pump having a plurality of rotor vanes consisting of a metal matrix composite.

9. The apparatus of claim 8 wherein the turbo-molecular pump has a rotor comprised of a metal matrix composite.

10. The apparatus of claim 8 wherein the turbo-molecular pump has a plurality of stator vanes comprised of a metal matrix composite.

11. The apparatus of claim 10 wherein the turbo-molecular pump has a stator comprised of a metal matrix composite.

12. The apparatus of claim 8 wherein the metal matrix composite comprises a metal base and a strengthening additive.

13. The apparatus of claim 12 wherein the metal base is aluminum.

14. The apparatus of claim 12 wherein the strengthening additive comprises an additive selected from the group consisting of: silicon carbide whiskers, fibers of boron metal, fibers of carbon, fibers of aluminum silicate, fibers of aluminum oxide, aluminum oxide particulates, boron carbide particles, silicon hexaboride particles and silicon carbide particles.

15. A vacuum processing system, comprising:

(a) a vacuum processing chamber; and (b) a turbo-molecular pump having a plurality of rotor vanes consisting of a metal matrix composite.

* * * * *

UNITED STATES PATENT AND TRADEMARK OFFICE

CERTIFICATE OF CORRECTION

PATENT NO. : 6,095,754
DATED : August 1, 2000
INVENTOR(S) : Ono et al.

It is certified that error appears in the above-identified patent and that said Letters Patent is hereby corrected as shown below:

Title page,
Item [56], please replace "Kieler" with -- Fieler --.

References Cited, please insert -- 3,762,835 10/02/1973 Carlson et al. 416 224, 5,487,825 01/30/1996 Kurze et al. 205 200, WO 96/38247 12/05/1996 WIPO B22D 19/00 --.

OTHER PUBLICATIONS, please insert -- PCT International Search Report dated August 19, 1999 --.

Signed and Sealed this

Fifth Day of February, 2002

*Attest:*

*Attesting Officer*

JAMES E. ROGAN
*Director of the United States Patent and Trademark Office*